US005800576A

United States Patent [19]

Johnson et al.

[11] Patent Number: 5,800,576

[45] Date of Patent: Sep. 1, 1998

[54] WATER CLUSTERS AND USES THEREFOR

[75] Inventors: Keith H. Johnson, Cambridge, Mass.; Bin Zhang, Milpitas, Calif.; Harry C. Clark, Townsend, Mass.

[73] Assignee: Quantum Energy Technologies Corporation, Cambridge, Mass.

[21] Appl. No.: 747,862

[22] Filed: Nov. 13, 1996

[51] Int. Cl.[6] ..... C01L 1/32

[52] U.S. Cl. ..... 44/301; 44/302

[58] Field of Search ..... 44/301, 302

[56] References Cited

U.S. PATENT DOCUMENTS

| | | | |
|---|---|---|---|
| 4,355,969 | 10/1982 | Nelson et al. | 44/301 |
| 4,394,131 | 7/1983 | Marro, Jr. et al. | 44/301 |
| 4,907,368 | 3/1990 | Mullay et al. | 44/302 |
| 5,051,583 | 9/1991 | Mimura et al. | 250/288 |
| 5,196,129 | 3/1993 | Luisi | 44/301 |
| 5,478,365 | 12/1995 | Nikanjam et al. | 44/280 |
| 5,503,772 | 4/1996 | Rivas et al. | 44/301 |
| 5,505,876 | 4/1996 | Rivas et al. | 44/301 |
| 5,581,081 | 12/1996 | Kato et al. | 250/288 |
| 5,603,864 | 2/1997 | Silva et al. | 44/301 |
| 5,622,920 | 4/1997 | Rivas et al. | 44/301 |
| 5,725,609 | 3/1998 | Rivas et al. | 44/301 |

*Primary Examiner*—Ellen M. McAvoy

*Attorney, Agent, or Firm*—Choate, Hall & Stewart; Sam Pasternack; Brenda H. Jarrell

[57] ABSTRACT

The present invention provides water cluster compositions characterized by high oxygen reactivity due to protruding, delocalized pπ orbitals. The invention also provides methods of producing the structures. The invention further provides methods of using the water clusters, for example in combustion, and compositions associated therewith.

46 Claims, 18 Drawing Sheets

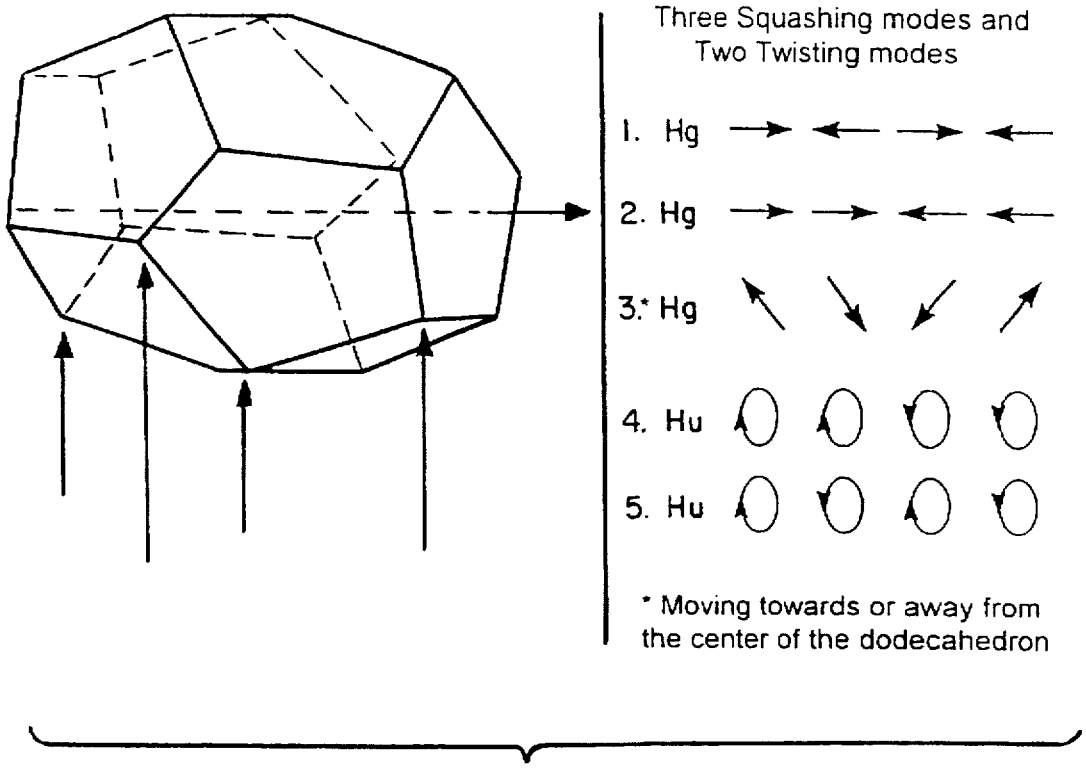
FIG.5
FIG.6
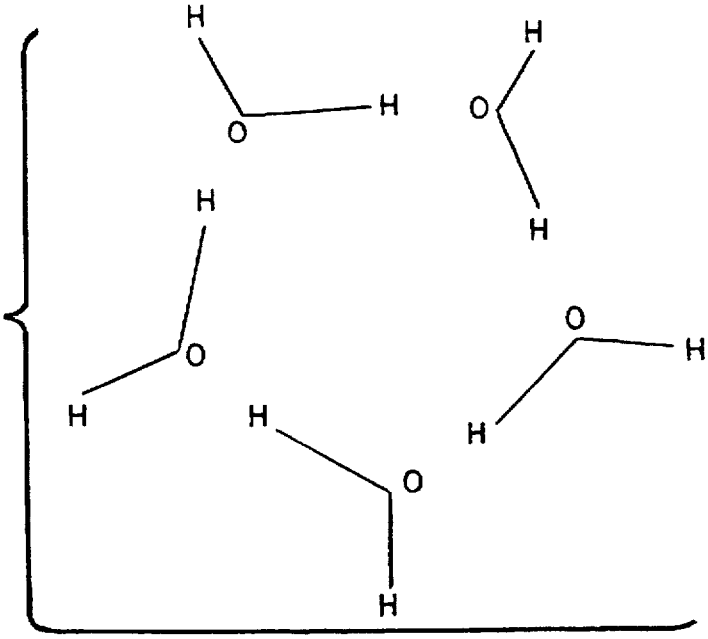

WATER CLUSTERS AND USES THEREFOR

BACKGROUND OF THE INVENTION

Due to its critical importance in processes ranging from heat transfer to solvation and biological reactions, water has been extensively studied. However, the microscopic structure of water is still poorly understood. Only recently have systematic studies been undertaken to evaluate complex water structures (see, for example, Pugliano et al., *Science* 257:1937, 1992). None of the studies performed to date, all of which focus on hydrogen bonding capabilities, has provided a full picture of the structure and properties of water. Accordingly, there remains a need for development of a more accurate understanding of water structure and characteristics. Moreover, mechanisms for harnessing water's extraordinary properties for practical applications are required.

SUMMARY OF THE INVENTION

The present invention provides an analysis of water structure that reveals unexpected characteristics of certain molecular arrangements. While most prior investigations have focussed on the role of hydrogen bonding in water, the present invention encompasses the discovery that second-nearest neighbor interactions between oxygen atoms in adjacent water molecules help determine the long-range properties of water.

The present invention provides the discovery that oxygens on neighboring water molecules can interact with one another through overlap of oxygen p orbitals. This overlap produces degenerate, delocalized pπ orbitals that mediate long-range interactions among water molecules in liquid water. The present invention provides the further discovery that, in clusters of small numbers of water molecules, interactions among the water molecules can produce structures in which pπ orbitals protrude from the structure surface in a manner that renders them available for reaction with other atoms or molecules. The invention therefore provides water clusters containing reactive oxygens. Preferred clusters have at least pentagonal symmetry. Also, it is preferred that oxygen-oxygen vibrational modes in the clusters are induced, either through application of an external field or through intrinsic action of the dynamical Jahn-Teller (DJT) effect.

DESCRIPTION OF THE DRAWINGS

FIG. 2 depicts the preferred relative orientation of adjacent water molecules.

FIG. 5 depicts "squashing" and "twisting" vibrational modes associated with oxygen-oxygen interactions in pentagonal dodecahedral water structures.

FIG. 6 depicts a pentagonal, 5-molecule water cluster.

DESCRIPTION OF PREFERRED EMBODIMENTS

As discussed above, the present invention encompasses a new theory of interactions between and among water molecules. In order to facilitate the understanding of the invention, we begin with a basic discussion of what is known about water structure.

Figure 1:
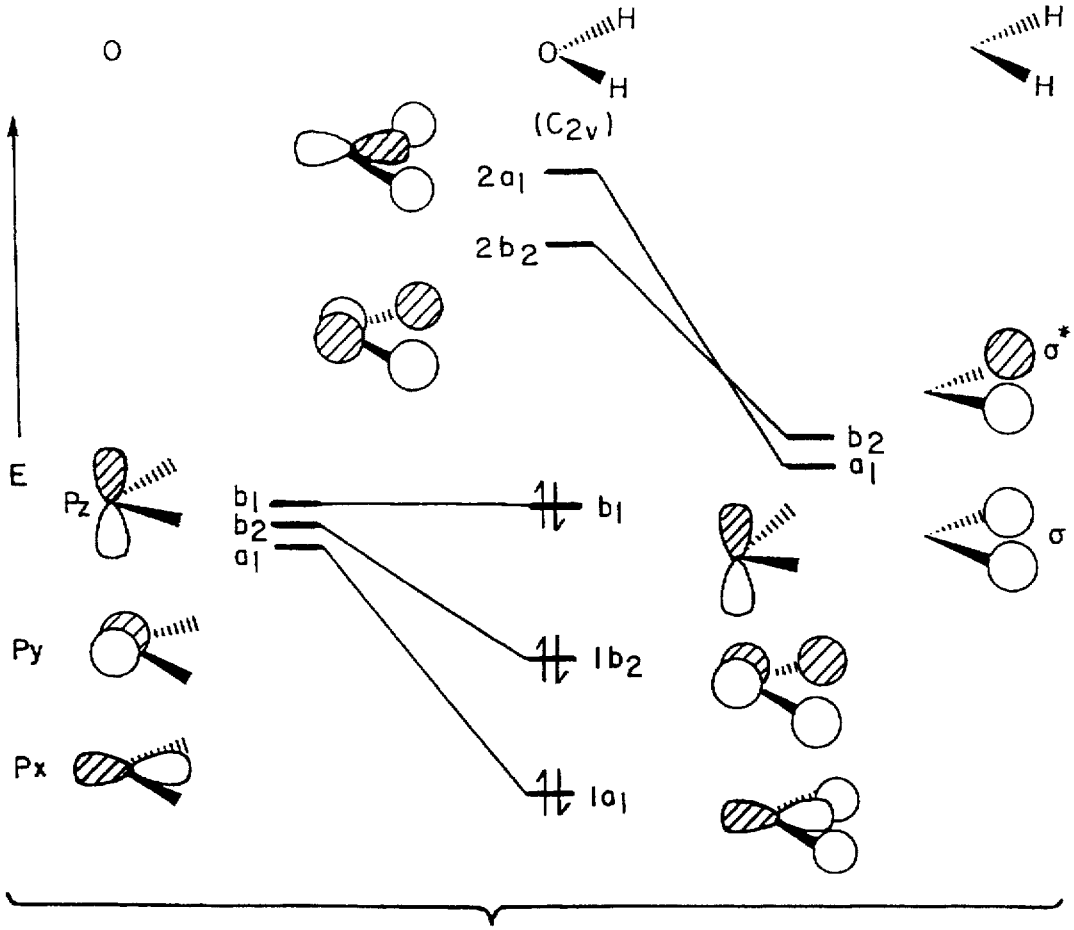
FIG. 1 depicts a representation of the molecular orbitals of water.

FIG. 1 depicts the molecular orbital structure of a single water molecule. As can be seen, this structure can be effectively modeled as an interaction between an oxygen atom (left side) and a hydrogen ($H_2$) molecule (right side). Oxygen has three p orbitals ($p_x$, $p_y$, and $p_z$) available for interaction with the hydrogen molecule's σ (bonding) and σ* (antibonding) orbitals. Interaction between the oxygen and the hydrogen molecule produces three bonding orbitals: one that represents a bonding interaction between the oxygen $p_x$ orbital and the hydrogen σ orbital; one that represents interaction of the oxygen $p_y$ orbital with the antibonding hydrogen σ* orbital; and one that represents the oxygen $p_z$ orbital. In FIG. 1, these orbitals are labelled with their symmetry designations, $1a_1$, $1b_2$, and $b_1$, respectively.

The oxygen-hydrogen molecule interaction also produces two antibonding orbitals: one that represents an antibonding interaction between the oxygen $p_y$ orbital and the hydrogen σ* orbital; and one that represents an antibonding interaction between the oxygen $p_x$ orbital and the hydrogen σ orbital. These orbitals are also given their symmetry designations, $2b_2$ and $2a_1$, respectively, in FIG. 1. For simplicity, the orbitals depicted in FIG. 1 will hereinafter be referred to by their symmetry designations. For example, the oxygen $p_z$ orbital present in the water molecule will be referred to as the water $b_1$ orbital.

Figure 2A:
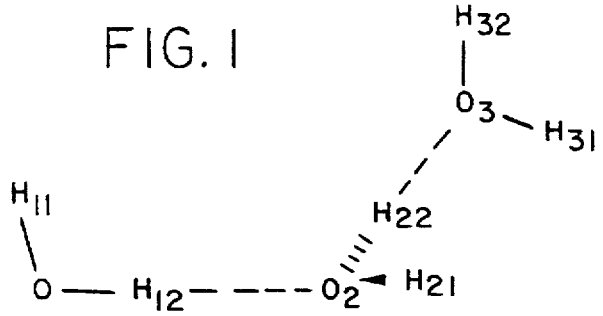
FIG. 2A shows the relative orientations of the atoms in neighboring molecules.
Figure 2B:
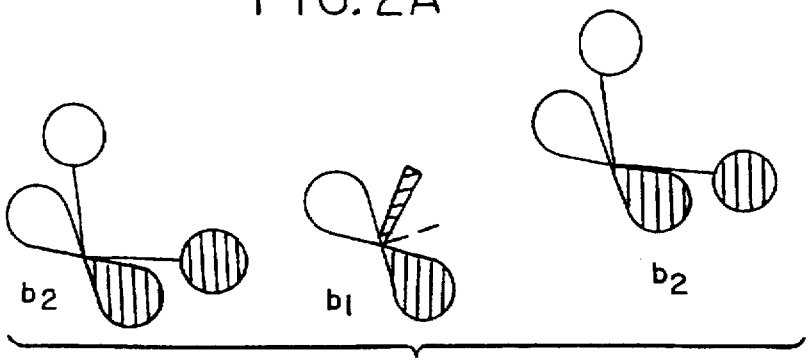
FIG. 2B shows the relative orientations of molecular orbitals.

The present invention provides the discovery that, when water molecules are positioned near each other in appropriate configurations, the $b_1$ orbital on a first water oxygen will interact with the $1b_2$ orbital on an adjacent, second water molecule, which in turn will interact with the $b_1$ orbital of a third adjacent water molecule, etc. As shown in FIG. 2, when successive water molecules are oriented perpendicular to one another (FIG. 2A), the $b_1$ and $1b_2$ orbitals on alternating molecules can interact (see FIG. 2B) to form delocalized pπ-type orbitals that extend along any number of adjacent waters.

Figure 3:
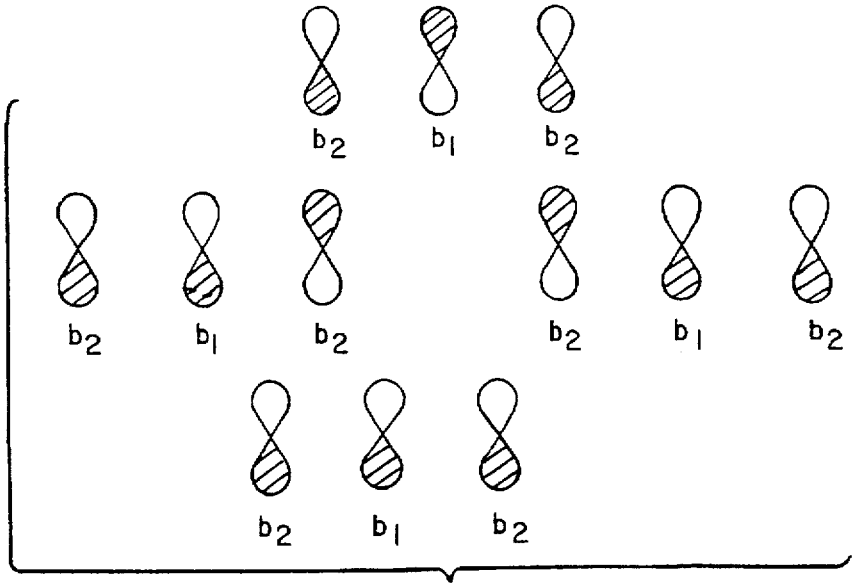
FIG. 3 presents pπ orbitals produced through interaction of three water molecules.
Figure 4:
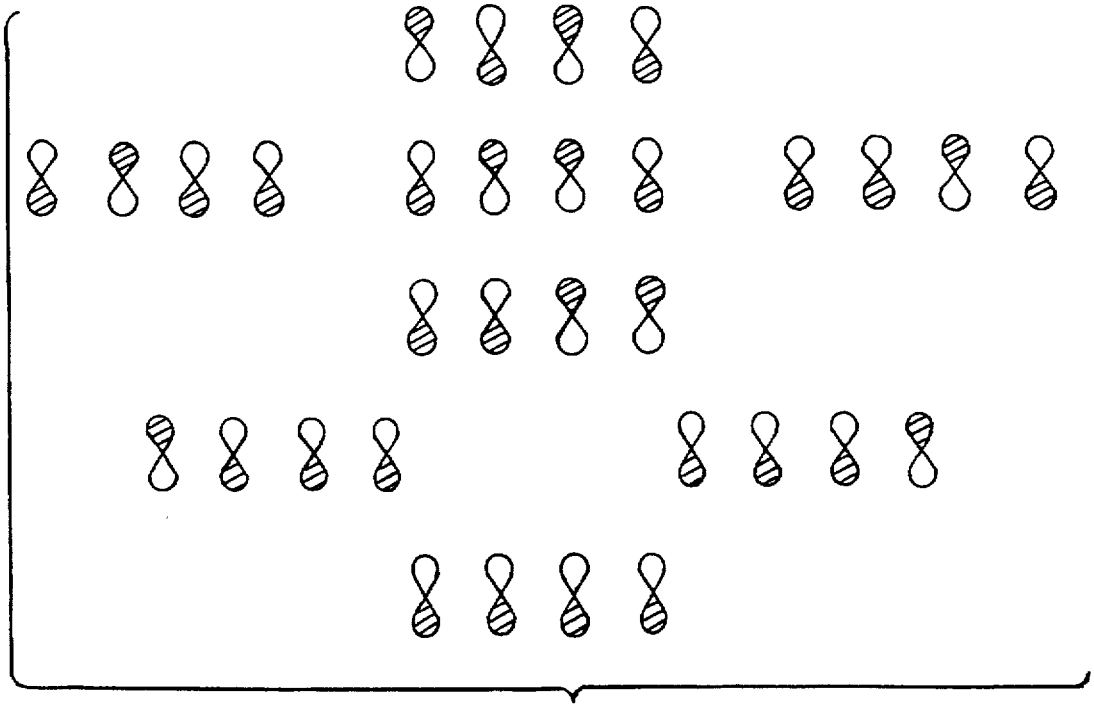
FIG. 4 presents pπ orbitals produced through interaction of four water molecules.

Those of ordinary skill in the art will readily appreciate that the larger the number of water molecules that are interacting with one another, the more different combinations of $b_1$ and $1b_2$ orbitals will be created, each producing a pπ orbital with a particular extent of bonding or antibonding character. For example, FIG. 3 presents possible pπ orbitals produced by combinations of $b_1$ and $1b_2$ orbitals on three water molecules; FIG. 4 present possible pπ orbitals produced by combinations of $b_1$ and $1b_2$ orbitals on four water molecules. As can be seen, the larger the number of interacting water molecules, the larger the manifold of possible pπ orbitals.

It will be appreciated that both the $b_1$ and $1b_2$ orbitals in water are occupied. Accordingly, the oxygen-oxygen interactions described by the present invention involve interactions of filled orbitals. Traditional molecular orbital theory teaches that interactions between such filled orbitals typically do not occur because, due to repulsion between the electron pairs, the antibonding orbitals produced by the interaction are more destabilized than the bonding orbitals are stabilized. However, in the case of interacting oxygen atoms on adjacent water molecules, the interacting atoms are farther apart (about 2.8 Å, on average) than they would be if they were covalently bonded to one another. Thus, the electron-pair repulsion is weaker than it would otherwise be and such asymmetrical orbital splitting is not expected to occur. In fact, some "bonding" and "antibonding" orbital combinations can have substantially identical energies. The highest occupied molecular orbital (HOMO) in water is, therefore, a manifold of substantially degenerate pπ orbitals with varying bonding and antibonding character; the lowest unoccupied molecular orbital (LUMO) in water represents a manifold of states corresponding to interactions involving $2b_2$ orbitals an adjacent water molecules.

As described above, one aspect of the invention is the discovery that oxygen-oxygen interactions can occur among neighboring water molecules through overlap of $b_1$ and $1b_2$ orbitals on adjacent oxygens that produces degenerate, delocalized pπ orbitals. A further aspect of the invention is the recognition that such pπ orbitals, if made to protrude from the surface of a water structure, can impart high reactivity to oxygens within that structure. The inventors draw an analogy between the presently described water oxygen pπ orbitals and dπ orbitals known to impart reactivity to certain chemical catalysts (see, for example Johnson, in *The New World of Quantum Chemistry*, ed. by Pullman et al., Reidel Publishing Co., Dorderecht-Holland, pp. 317–356, 1976. According to the present invention, water oxygens can be made to catalyze their own oxidative addition to other molecules by incorporating them into water structures in which pπ orbitals associated with oxygen-oxygen interactions protrude from the structure surface.

A further aspect of the invention provides the recognition that reactivity of water oxygens within structures having protruding pπ orbitals can be enhanced through amplification of certain oxygen-oxygen vibrational modes. It is known that the rate limiting step associated with oxidative addition of an oxygen atom from $O_2$ is the dissociation of the oxygen atom from the $O_2$ molecule. Thus, in general, oxygen reactivity can be enhanced by increasing the ease with which the oxygen can be removed from the molecule with which it is originally associated. The present inventors have recognized that enhancement of oxygen-oxygen vibrational modes in water clusters increases the probability that a particular oxygen atom will be located a distance from the rest of the structure. Where the oxygen is participating in interactions that create a protruding pπ orbital, displacement of the oxygen away from the structure increases the probability that the pπ orbital will have the opportunity to overlap with orbitals of a potential reaction partner, and therefore increases the reactivity of the oxygen atom. Essentially, the vibrations create an orbital steering effect.

The present invention therefore provides "water clusters" that are characterized by high oxygen reactivity as a result of their orbital and vibrational characteristics. A "water cluster", as that term is used herein, describes any arrangement of water molecules that has sufficient "surface reactivity" due to protruding pπ orbitals that the reactivity of cluster oxygens with other reactants is enhanced relative to the reactivity of oxygens in liquid water. Accordingly, so long as a sufficient number of pπ orbitals protrude from the cluster of water molecules in a way that allows increased interaction with nearby reactants, the requirements of the present invention are satisfied.

Preferred water clusters of the present invention have symmetry characteristics. Symmetry increases the degeneracy of the pπ orbitals and also produces more delocalized orbitals, thereby increasing the "surface reactivity" of the cluster. Symmetry also allows collective vibration of oxygen-oxygen interactions within the clusters, so that the likelihood that a protruding pπ orbital will have an opportunity to overlap with a potential reactant orbital is increased. Particularly preferred water clusters comprise pentagonal arrays of water molecules, and preferably comprise pentagonal arrays with maximum icosahedral symmetry. Most preferred clusters comprise pentagonal dodecahedral arrays of water molecules.

Water clusters comprising pentagonal arrays of water molecules are preferred at least in part because of their vibrational modes that can contribute to enhanced oxygen reactivity are associated with the oxygen-oxygen "squashing" and "twisting" modes (depicted for a pentagonal dodecahedral water structure in FIG. 5). These modes have calculated vibrational frequencies that i.e. between the far infrared and microwave regions of the electromagnetic spectrum, within the range of approximately 250 $cm^{-1}$ to 5 $cm^{-1}$. Induction of such modes may be accomplished resonantly, for example through application of electrical, electromagnetic, and/or ultrasonic fields, or may be accomplished intrinsically through the dynamical Jahn-Teller effect.

The DJT effect refers to a symmetry-breaking phenomenon in which molecular vibrations of appropriate frequency couple with certain degenerate energy states available to a molecule, so that those states are split away from the other states with which they used to be degenerate (for review, see Bersuker et al., *Vibronic Interactions in Molecules and Crystals*, Springer Verlag, N.Y., 1990). Thus, natural coupling between the oxygen-oxygen vibrations and the degenerate pπ molecular orbitals of water clusters of the present invention can enhance oxygen reactivity.

Water clusters having pentagonal symmetry are particularly preferred because adjacent pentagonal clusters repel each other, importing kinetic energy to the clusters that can contribute to their increased reactivity.

It will be appreciated that not all of the molecules in the water clusters of the present invention need be water molecules per se. For example, molecules (such as alcohols, amines, etc.) that represent a substitution of a water hydrogen can be incorporated into water clusters of the invention without disrupting the oxygen-oxygen interactions. Methonal, ethanol, or any other substantially saturated alcohol is suitable in this regard. Other atoms, ions, or molecules can additionally or alternatively be included in the structure so long as they don't interfere with protrusion of the interactive pπ orbital(s). The structures themselves may also be protonated or ionized. Given that not all of the molecules in the cluster need be water molecules, we herein describe certain desirable characteristics of inventive water clusters with reference to the number of oxygens in the cluster.

Preferred water clusters of the present invention are "nanodroplets", preferably smaller than about 20 Å in their longest dimension, and preferably comprising between about 5 and 300 oxygens. Particularly preferred clusters include between about 20 and 100 oxygens. Most preferred water clusters contain approximately 20 oxygens and have pentagonal dodecahedral symmetry.

Figure 7:
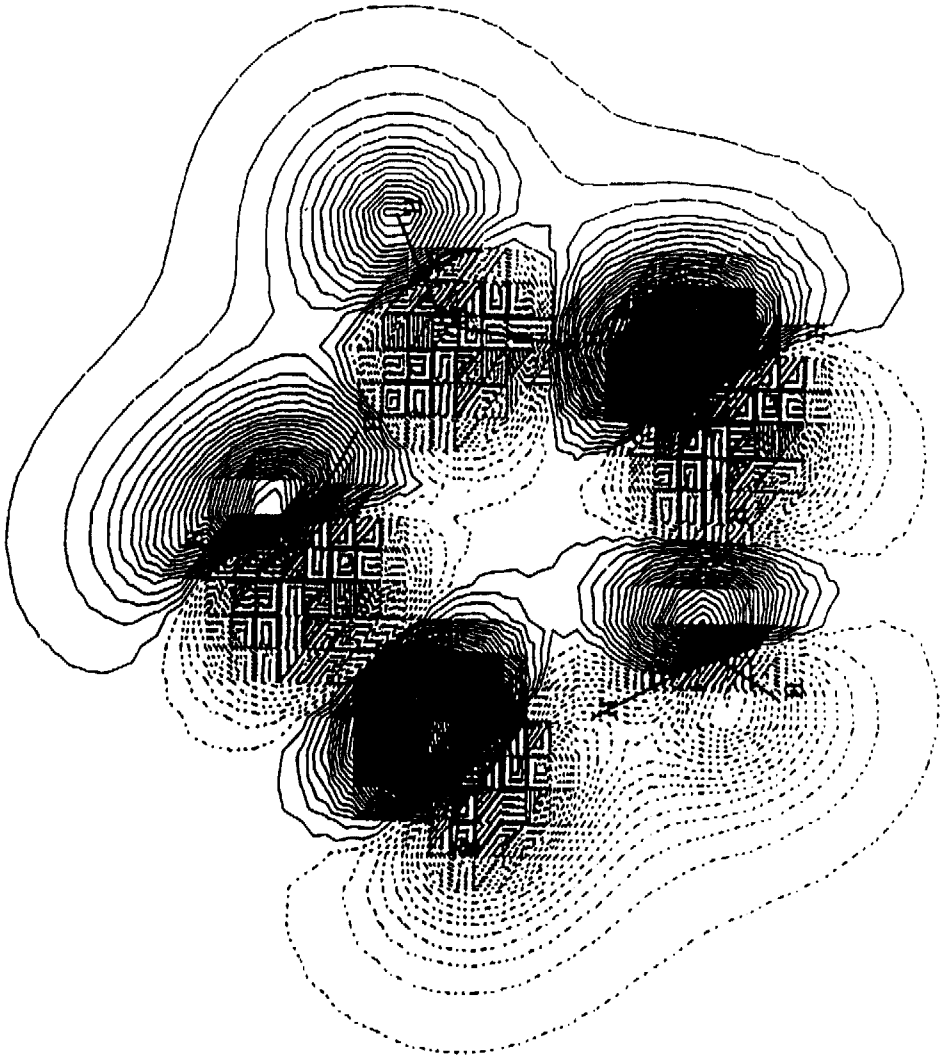
FIG. 7 shows one of the delocalized pπ orbitals of the 5-molecule water cluster shown in FIG. 6.

Particular embodiments of preferred inventive water clusters for use in the practice of the present invention are presented in FIGS. 6–12. FIG. 6 shows a 5-molecule water cluster with pentagonal symmetry, FIG. 7 shows one of the pπ orbitals associated with this cluster. Solid lines represent the positive phase of the orbital wave function; dashed lines represent the negative phase. As can be seen with reference to FIG. 7, a delocalized pπ orbital forms that protrudes from the surface of the cluster. This orbital (and others) is available for interaction with orbitals of neighboring reaction partners. Overlap with an orbital lobe of the same phase as the protruding pπ orbital lobe will create a bonding interaction between the relevant cluster oxygen and the reaction partner.

Figure 8:
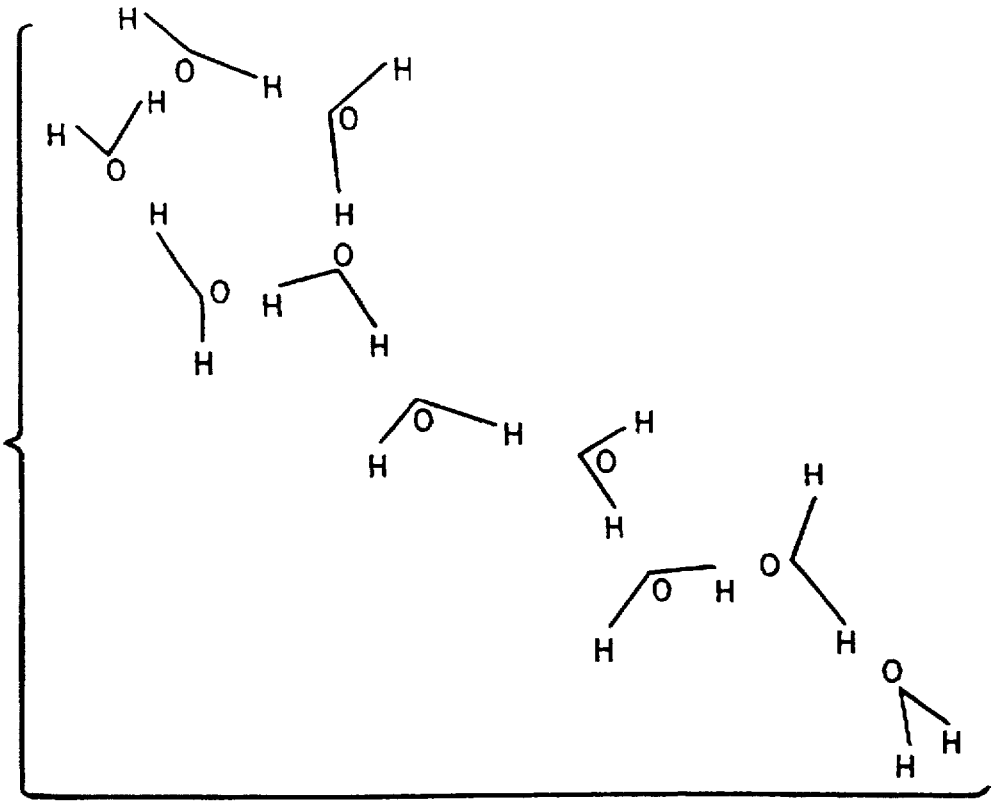
FIG. 8 depicts a 10-molecule water cluster having partial pentagonal symmetry.
Figure 9:
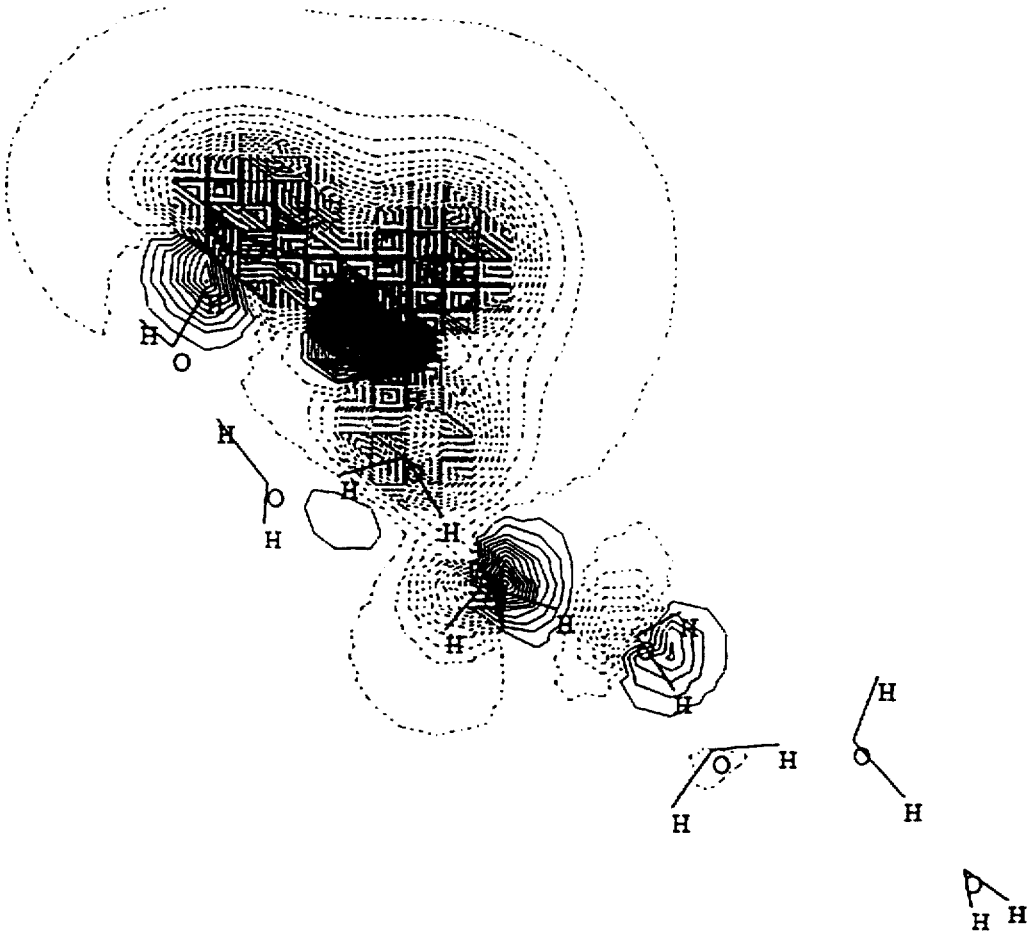
FIG. 9 shows one of the delocalized pπ orbitals of the 10-molecule water cluster shown in FIG. 8.

FIG. 8 shows a 10-molecule water cluster with partial pentagonal symmetry; FIG. 9 shows one of its delocalized pπ orbitals. As can be seen, the orbital delocalization (and protrusion) is primarily associated with the water molecules in the pentagonal arrangement. Thus, FIG. 9 demonstrates one of the advantages of high symmetry in the water clusters of the present invention: the pπ orbital associated with the pentagonally-arranged water molecules is more highly delocalized and protrudes more effectively from the surface. The orbital therefore creates surface reactivity not found with the oxygens in water molecules that are not part of the pentagonal array.

Figure 10:
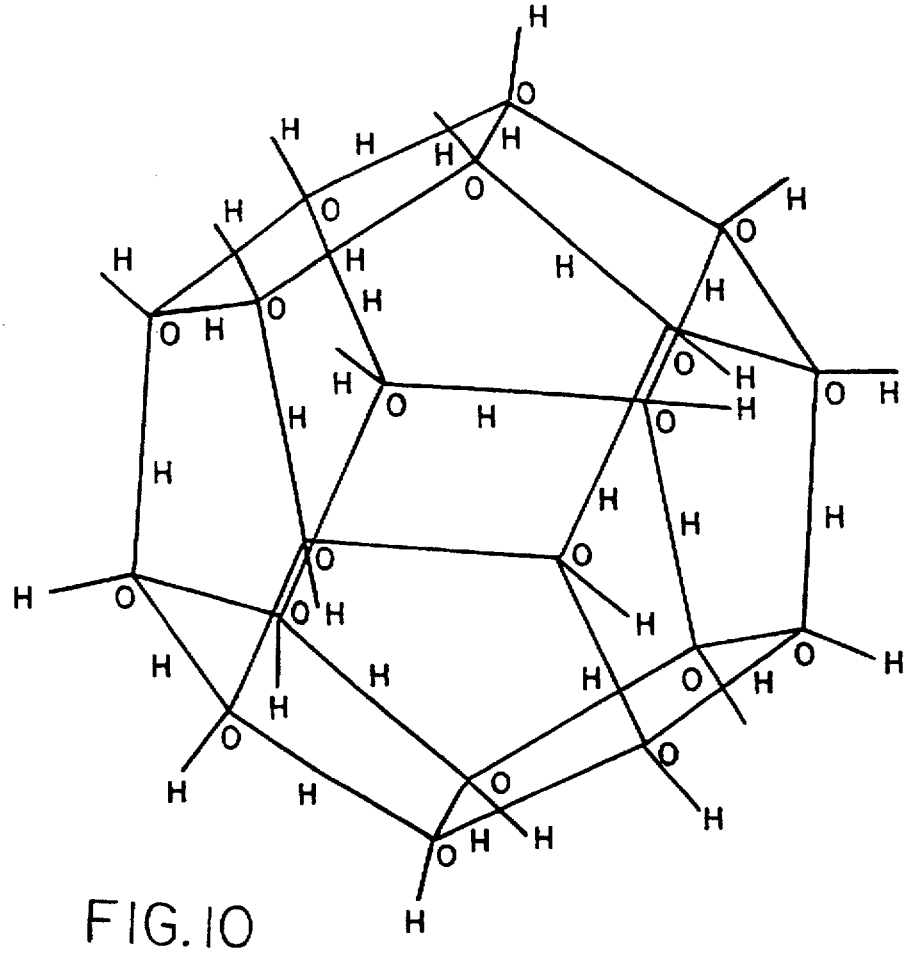
FIG. 10 shows a 20-molecule pentagonal dodecahedral water cluster.
Figure 11A:
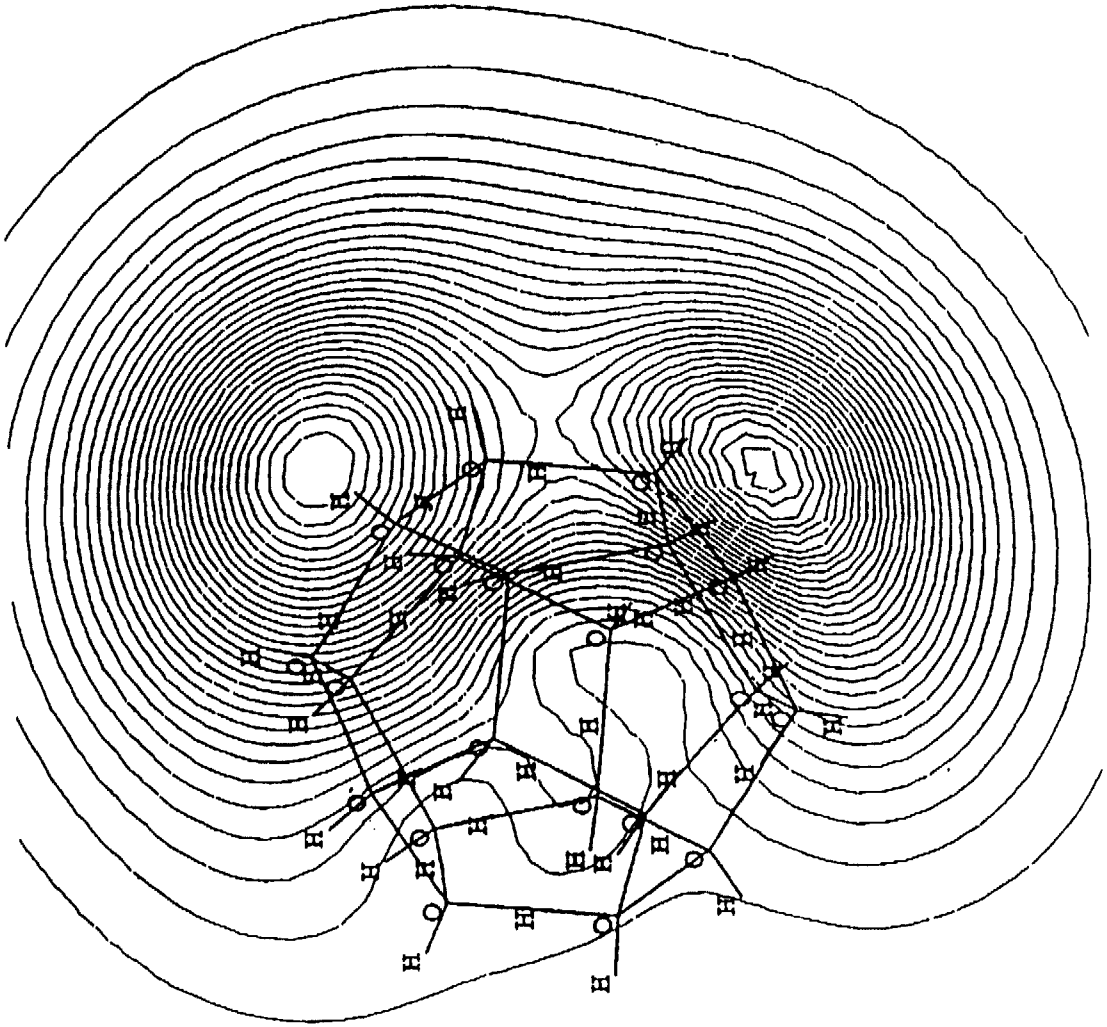
FIG. 11, Panels A–E, show different delocalized pπ orbitals associated with the 20-molecule pentagonal dodecahedral water cluster of FIG. 10.
Figure 11B:
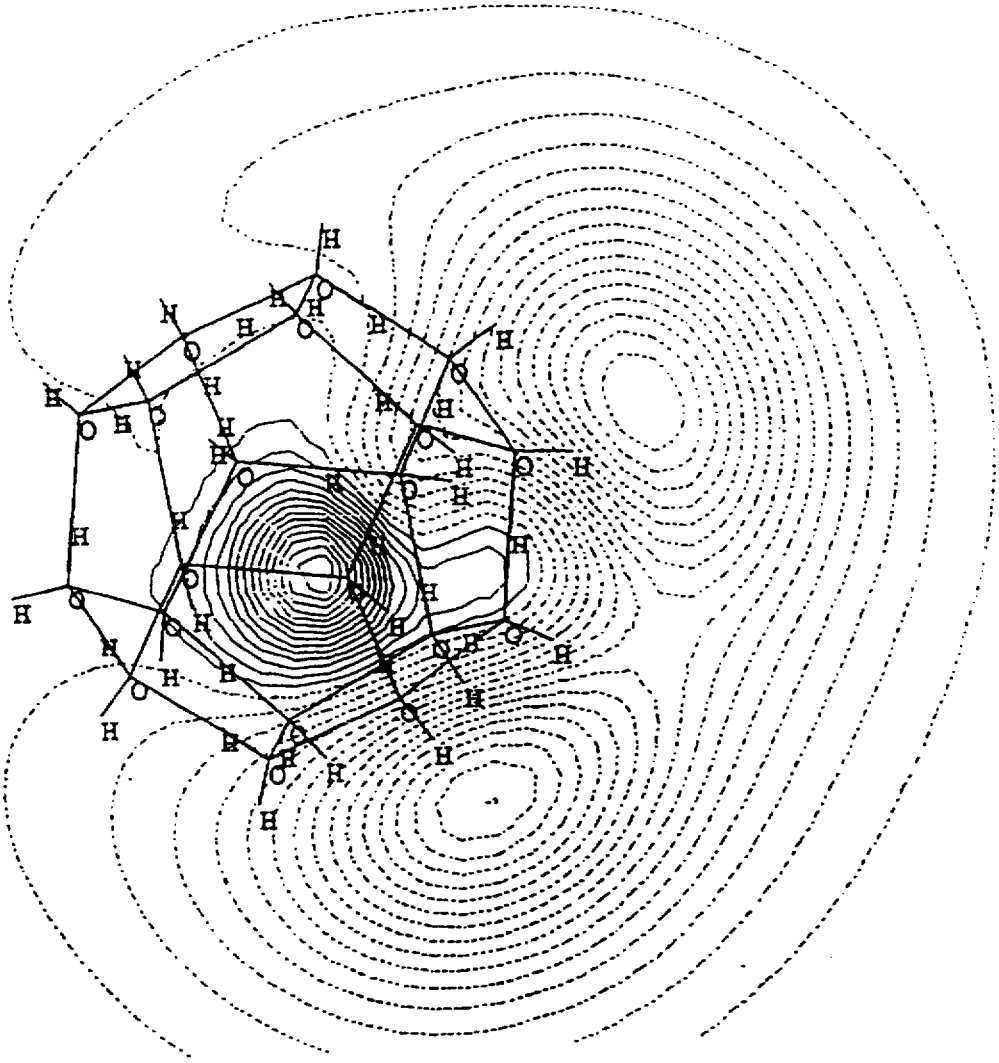
Figure 11C:
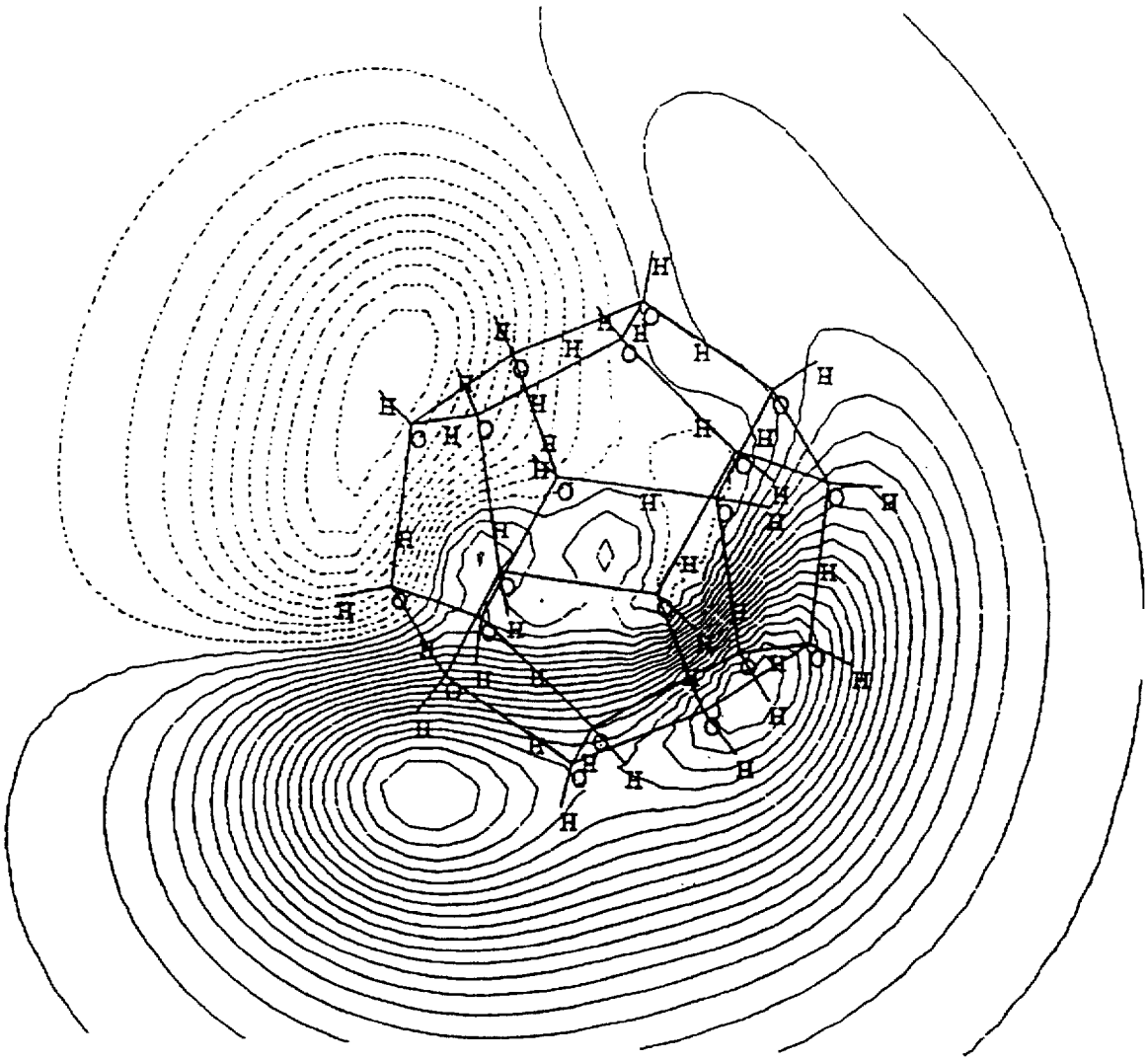
Figure 11D:
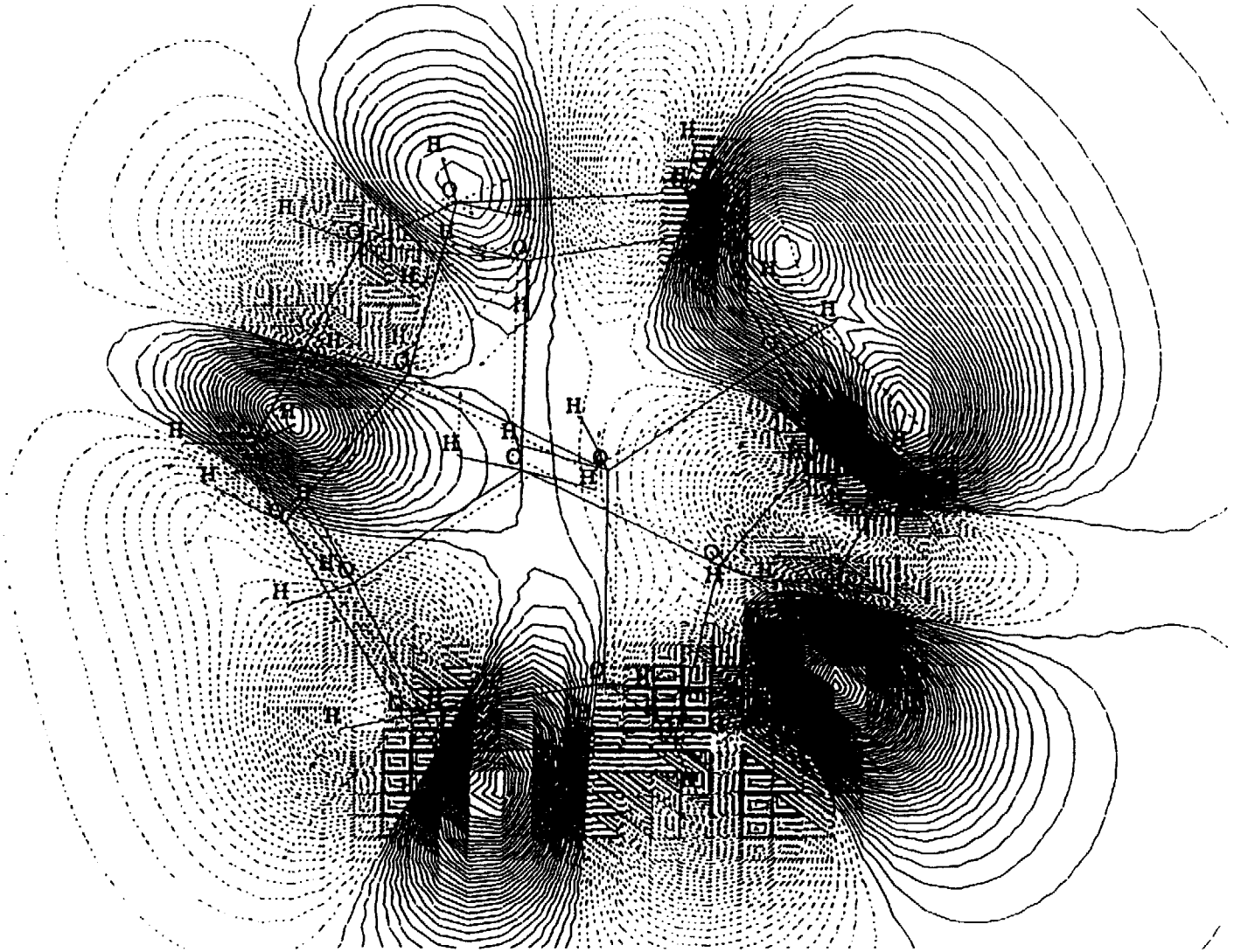
Figure 11E:
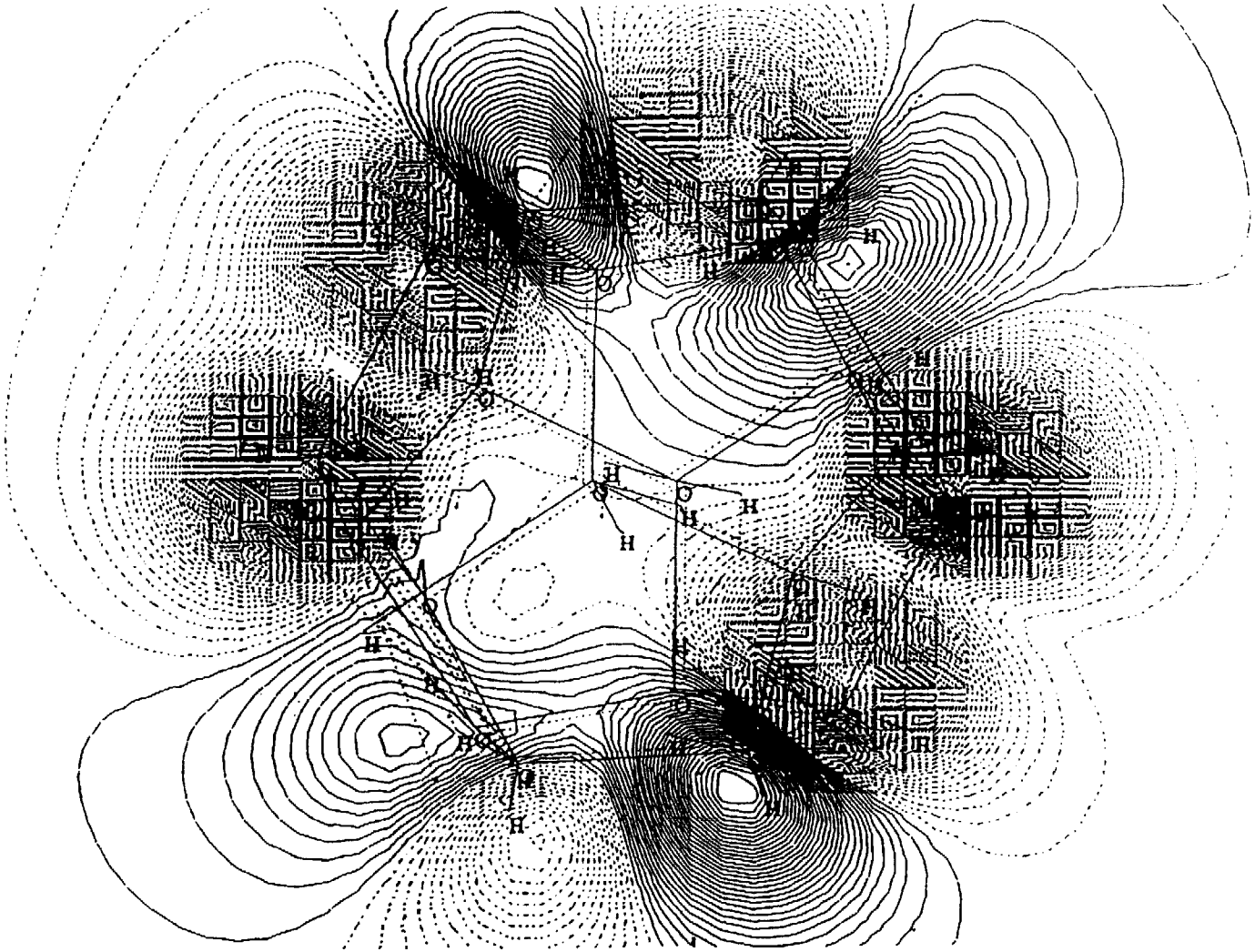
Figure 12:
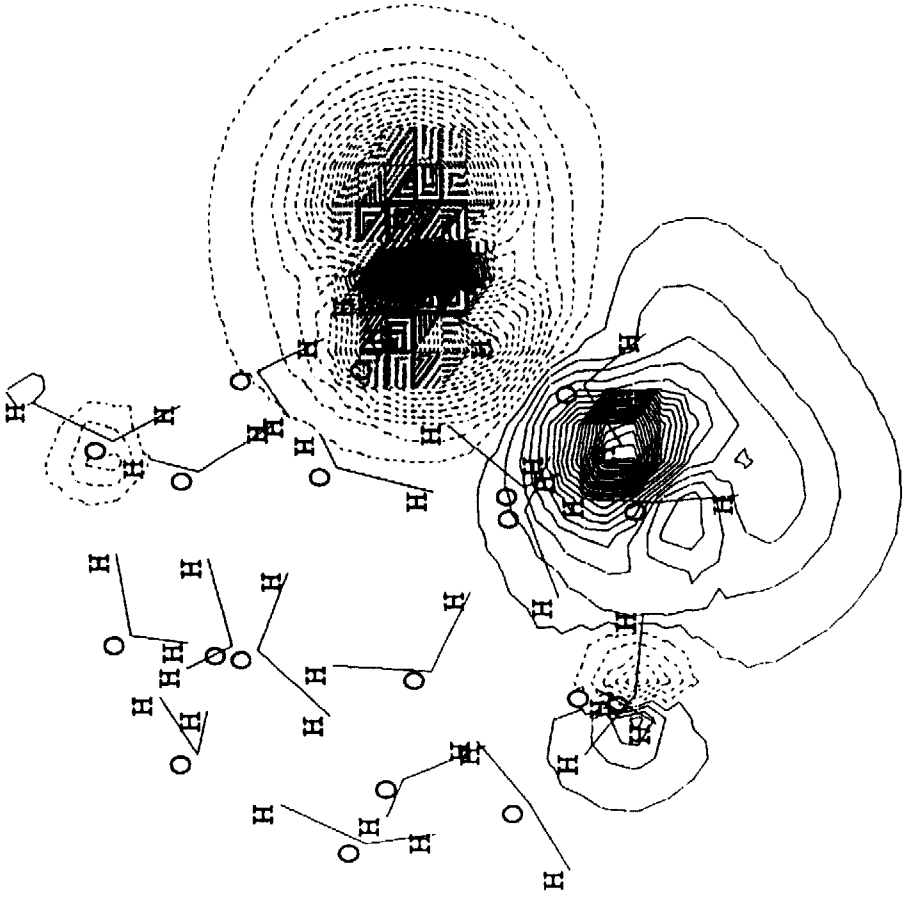
FIG. 12 shows an unoccupied antibonding pπ* orbital associated with the 20-molecule petagonal dodecahedral water cluster of FIG. 10.

FIG. 10 shows a 20-molecule water cluster with pentagonal dodecahedral symmetry; FIG. 11, Panels A–E show various of its pπ orbitals. Once again, extensive orbital delocalization and surface protrusion is observed in this highly symmetrical structure. For comparison, an unoccupied antibonding orbital associated with the same structure is depicted in FIG. 12. Much less delocalization is observed.

Water clusters comprising more than approximately 20 water molecules are not specifically depicted in Figures presented herein, but are nonetheless useful in the practice of the present invention. For example, clusters comprising approximately 80 molecules can assume an ellipsoidal configuration with protruding pπ orbitals at the curved ends. When clusters comprise more than approximately 300 water molecules, however, the cluster tends to behave more like liquid water, which shows low "surface reactivity." Of course, if the cluster were to comprise a large number (>300) of water molecules all arranged in stable symmetrical structures (e.g., several stable pentagonal dodecahedral), these problems would not be encountered. Such large clusters are therefore within the scope of the present invention.

As has been mentioned, water clusters comprising pentagonal dodecahedral molecular arrangements are particularly preferred for use in the practice of the present invention. Accordingly, pentagonal dodecahedral water structures are discussed in more detail below. Those of ordinary skill in the art will appreciate, however, that the following discussion is not intended to limit the scope of the present invention, and that any and all embodiments encompassed by the prior broad description fall within the scope of the claims.

Pentagonal Dodecahedral Water Clusters

Pentagonal dodecahedral water structures (such as, for example, $(H_2O)_{20}$, $(H_2O)_{20}^{++}$, $(H_2O)_{20}H^+$, and $(H_2O)_{21}H^+$, and analogous structures including alcohol molecules) are particularly preferred for use in the practice of the present invention because, as shown in FIG. 11, delocalized pπ orbitals protrude from the dodecahedron vertices, so that all 20 oxygens in the structure are predicted to have enhanced reactivity. Furthermore, Coulomb repulsion between like-charged dodecahedra can render pentagonal dodecahedral structures kinetically energetic. Also, the symmetry of the structure produces degenerate molecular orbitals that can couple with oxygen-oxygen vibrational modes in the far infrared to microwave regions, resulting in increased reactivity of the structure oxygens. As discussed above, these modes can be induced through application of appropriate fields, or through the dynamical Jahn-Teller effect.

It should be noted that pentagonal dodecahedral water structures had been produced and analyzed well before the development of the present invention. As early as 1973, researchers were reporting unexpected stabilities of water clusters of the form $H^+(H_2O)_{20}$ and $H^+(H_2O)_{21}$ (see, for example, Lin, *Rev. Sci. Instrum.* 44:516, 1973; Searcy et al., *J. Chem. Phys.* 61:5282, 1974; Holland et al., *J. Chem. Phys.* 72:11, 1980; Yang et al., *J. Am. Chem. Soc.* 111:6845, 1989; Wei et al., *J. Chem. Phys.* 94:3268, 1991). However, prior art analyses of these structures centered around discussions of hydrogen bond interactions, and struggled to explain their structure and energetics (see, for example, Laasonen et al., *J. Phys. Chem.* 98:10079, 1994). No prior art reference discussed the oxygen-oxygen interactions described herein, and none recognized the increased reactivity of cluster oxygens. Moreover, no prior art reference recognized the desirability of inducing particular vibrational modes in these clusters in order to increase oxygen reactivity.

On the other hand, certain elements of the data collected in prior art studies are consistent with and can be explained by the theory presented herein. For example, the present invention predicts that low-frequency vibrations attributable to oxygen-oxygen bonds at the vertices of pentagonal dodecahedral structures should be observable by Raman scattering. Several groups have reported low frequency Raman scattering in water (see, for example, Rousset et al., *J. Chem. Phys.* 92:2150, 1990; Majolino et al., *Phys. Rev.* E47:2669, 1993; Mizoguchi et al., *J. Chem. Phys.* 97:1961, 1992), but each has offered its own explanation for the effect, none of which involves vibrations of oxygen-oxygen bonds at the vertices of pentagonal dodecahedral structures. In fact, Sokolov et al. recently, summarized the state of understanding of the observed low frequency vibrations by saying "the description of the spectrum and its relation with the critical behavior of other properties are still not clear" (Sokolov et al., *Phys. Rev. B* 51:12865, 1995). The present invention solves this problem.

The analysis of water structure provided by the present invention explains several observations about water properties that cannot be understood through studies of hydrogen bond interactions. For example, Seete et al. (*Phys. Rev. Lett* 75:850, 1995) have reported propagation of "fast sound" through liquid water is not dependent on the hydrogen isotope employed. Accordingly, fast sound cannot be propagating only on the hydrogen network.

According to the present invention, preferred pentagonal dodecahedral water structures include $(H_2O)_{20}$, $(H_2O)_{20}^{++}$, $(H_2O)_{20}H^+$, and $(H_2O)_{21}H^+$. Also preferred are structures including one or more alcohol molecules substituted for water. Preferred structures may also include clathrated (or otherwise bonded) ions, atoms, molecules or other complex organic or metallo-organic ligands. In fact, clathration can act to stabilize pentagonal dodecahedral water structures. Preferred clathration structures include $(H_2O)_{21}H^+$ structures in which an $H_3O^+$ molecule is clathrated within a pentagonal dodecahedral shell. Other preferred clathrated structures include those in which a metal ion is clathrated by pentagonal dodecahedral water.

Water clusters containing stable pentagonal dodecahedral water structures may be produced in accordance with the present invention by any of a variety of methods. In liquid water, pentagonal dodecahedral structures probably form transiently, but are not stable. In fact, liquid water can be modeled as a collection of pentagonal dodecahedra in which inter-structure interactions are approximately as strong as, or stronger than, intra-structure interactions. Accordingly, in order to produce stable pentagonal dodecahedral water structures from liquid water, the long-range inter-structure interactions present in liquid water must be disrupted in favor of the intra-structure association. Any of a variety of methods, including physical, chemical, electrical, and electromagnetic methods, can be used to accomplish this. For example, perhaps the most straightforward method of isolating pentagonal dodecahedral water structures is simply to isolate 20 or 21 water molecules in a single nanodroplet. Preferred water clusters of the present invention comprise 20 to 21 water molecules.

Other methods of producing pentagonal dodecahedral water structures include passing water vapor through a hypersonic nozzle, as is known in the art (see, for example Lin, *Rev. Sci. Instrum.* 44:516, 1973; Searcy et al., *J. Chem. Phys.* 61:5282, 1974). All known methods of hypersonic nozzling are useful in accordance with the present invention. The present invention, however, also provides an improved hypersonic nozzling method for preparing pentagonal dodecahedral water structures. Specifically, in a preferred embodiment of the present invention, the hypersonic nozzle comprises a catalytic material such as nickel or a nickel alloy positioned and arranged so that, as water passes through the nozzle, it comes in contact with reacting orbitals on the catalytic material. Under such conditions, the catalytic material is expected to disrupt inter-cluster bonding, by sending electrons into anti-bonding orbitals, without interfering with intra-cluster bonding interactions.

Chemical methods for producing water clusters comprising pentagonal dodecahedral structures include the use of surfactants and/or clathrating agents. Electrical methods include inducing electrical breakdown of inter-cluster interactions by providing an electrical spark of sufficient voltage and appropriate frequency. Electromagnetic methods include application of microwaves of appropriate frequency to interact with the "squashing" vibrational modes of inter-cluster oxygen-oxygen interactions. Also, since it is known that ultrasound waves can cavitate (produce bubbles in) water, it is expected that inter-cluster associations can be disrupted ultrasonically without interfering with intra-cluster interactions. Finally, various other methods have been reported for the production of pentagonal dodecahedral water structures as can be employed in the practice of the present invention. Such methods include ion bombardment of ice surfaces (Haberland, in *Electronic and Atomic Collisions*, ed. by Eichler et al., Elsevier, Ansterdam, pp. 597–604, 1984), electron impact ionization (Lin, *Rev. Sci. Instrum.* 44:516, 1973; Hermann et al., *J. Chem. Phys.* 72:185, 1982; Dreyfuss et al., *J. Chem. Phys.* 76:2031, 1982; Stace et al., *Chem. Phys. Lett.* 96:80, 1983; Echt et al., *Chem. Phys. Lett.* 108:401, 1989), and near-threshold vacuum-UV photoionization of neutral clusters (Shinohara et al., *Chem. Phys.* 83:4183, 1985; Nagashima et al., *J. Chem. Phys.* 84:209, 1986)??].

However the pentagonal dodecahedral water structures are initially produced, it may be desirable to ionize them (e.g., by passing them through an electrical potential after they are formed) in order to increase their kinetic energy, and therefore their reactivity, through coulombic repulsion.

Applications

As described above, the present invention provides water clusters that include reactive oxygens. The invention also provides methods of using such clusters, particularly in "oxidative" reactions (i.e., in reactions that involve transfer of an oxygen from one molecule to another). The clusters can be employed in any oxidative reaction, in combination with any appropriate reaction partner.

One particularly useful application of the water structures of the present invention is in combustion. According to the present invention, the reactive water oxygens can efficiently combine with carbon in a fuel so that the specific energy of the combustion reaction is increased.

Figure 13:
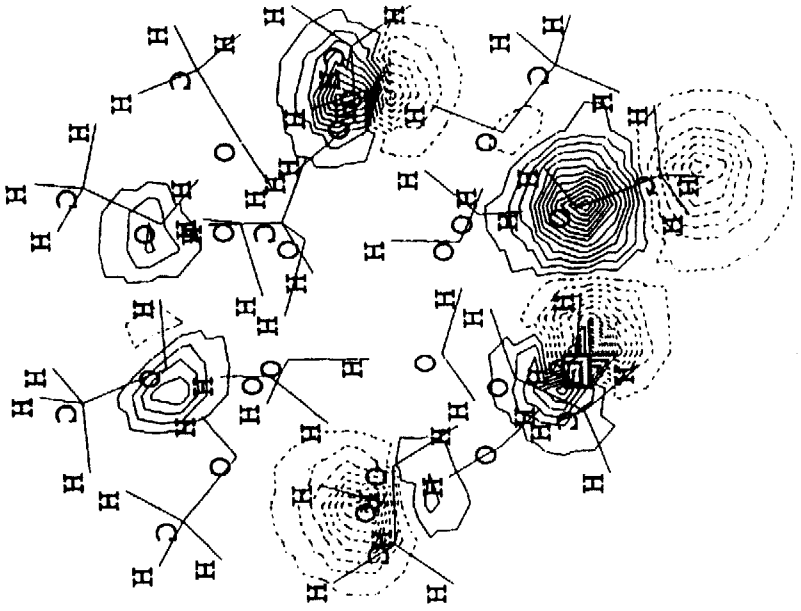
FIG. 13 shows a pπ orbital in a pentagonal dodecahedral water/methanol structure.
Figure 14:
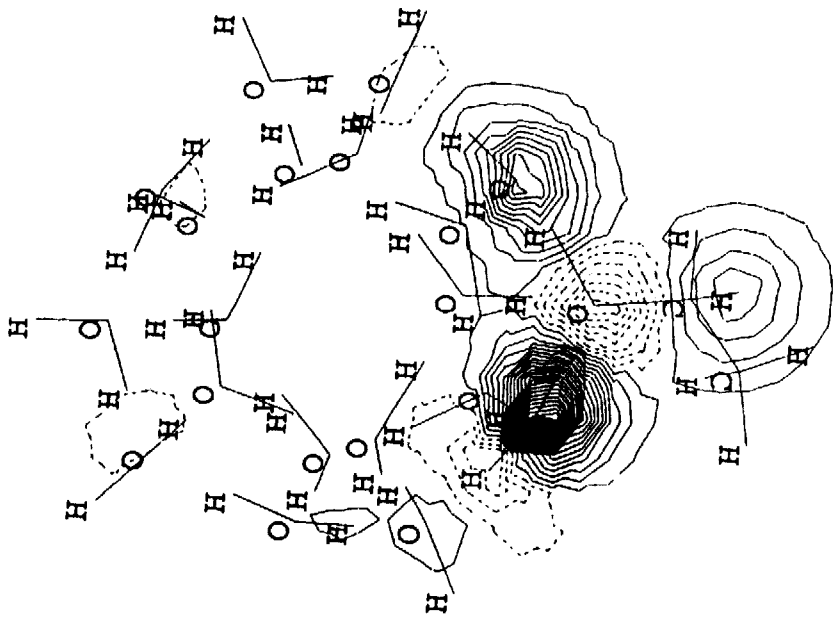
FIG. 14 shows a pπ orbital in a pentagonal dodecahedral water/ethanol structure.

In order to model the reactivity of water structure oxygens with neighboring carbons, the inventors have analyzed pentagonal dodecahedral clusters in water cluster/methanol and water cluster/ethanol mixtures. FIGS. 13 and 14 present calculated $p\pi$ orbitals for these structures. As can be seen with both structures, the depicted orbital has the same phase with respect to the carbon and its adjacent oxygen. By contrast, the orbital phase often shifts between the oxygen and neighboring hydrogens. Electron density between the carbon and oxygen is high.

The structures depicted in FIGS. 3 and 14 model systems in which an isolated pentagonal dodecahedral water cluster is surrounded with hydrocarbon molecules. The high electron density between the cluster oxygen and adjacent carbon indicate that the likelihood that the oxygen will be oxidatively added to the carbon is increased. Thus, the present invention teaches that dispersions of water droplets in fuel should have enhanced specific energy of combustion as compared with fuel alone. Accordingly, one aspect of the present invention comprises combustible compositions comprising clusters dispersed in fuel. The compositions are designed to include water structures with reactive oxygens and to maximize interaction of the fuel with those oxygens.

Fuels that can usefully be employed in the water cluster/fuel compositions of the present invention include any hydrocarbon source capable of interaction with reactive oxygens in water clusters of the present invention. Preferred fuels include gasoline and diesel. Diesel fuel is particularly preferred.

Water cluster/fuel compositions of the present invention may be prepared by any means that allows formation of water clusters with reactive oxygens and exposes a sufficient number of such reactive oxygens to the fuel so that the specific energy of combustion is enhanced as compared to the specific energy observed when pure fuel is combusted under the same conditions. Preferably, stable water structures that contain reactive oxygens are prepared prior to introduction of the water into the water cluster/fuel compositions. Surfactants may be employed to stabilize the water cluster/fuel compositions if desired.

In order that the fuel in the water cluster/fuel compositions of the present invention be exposed to the maximum number of reactive oxygens, it is desirable to minimize the size of the water clusters in the water cluster/fuel compositions. Preferably, the water clusters have an average diameter of no more than about 20 Å along their longest dimension. More preferably, each droplet comprises less than about 300 water molecules. In particularly preferred embodiments, the water/cluster fuel composition comprises individual pentagonal dodecahedral water clusters are dispersed within the fuel.

It will be appreciated that the extent of interaction between the hydrocarbon fuel and reactive oxygens in the water will depend not only on the size (and surface reactivity) of the water clusters in the composition, but also on the number of water clusters dispersed within the fuel. Preferred water cluster/fuel compositions contain at least about 5% water, preferably at least about 20–30%. Particularly preferred water cluster/fuel compositions contain at least about 50% water.

As mentioned above, the water cluster/fuel compositions of the present invention are preferably prepared so that the specific energy of combustion is higher than that of pure fuel. Preferably, the specific energy is increased at least about 1–2%, more preferably at least about 10%, still more preferably at least about 15–20%, and most preferably at least about 50%.

Figure 16:
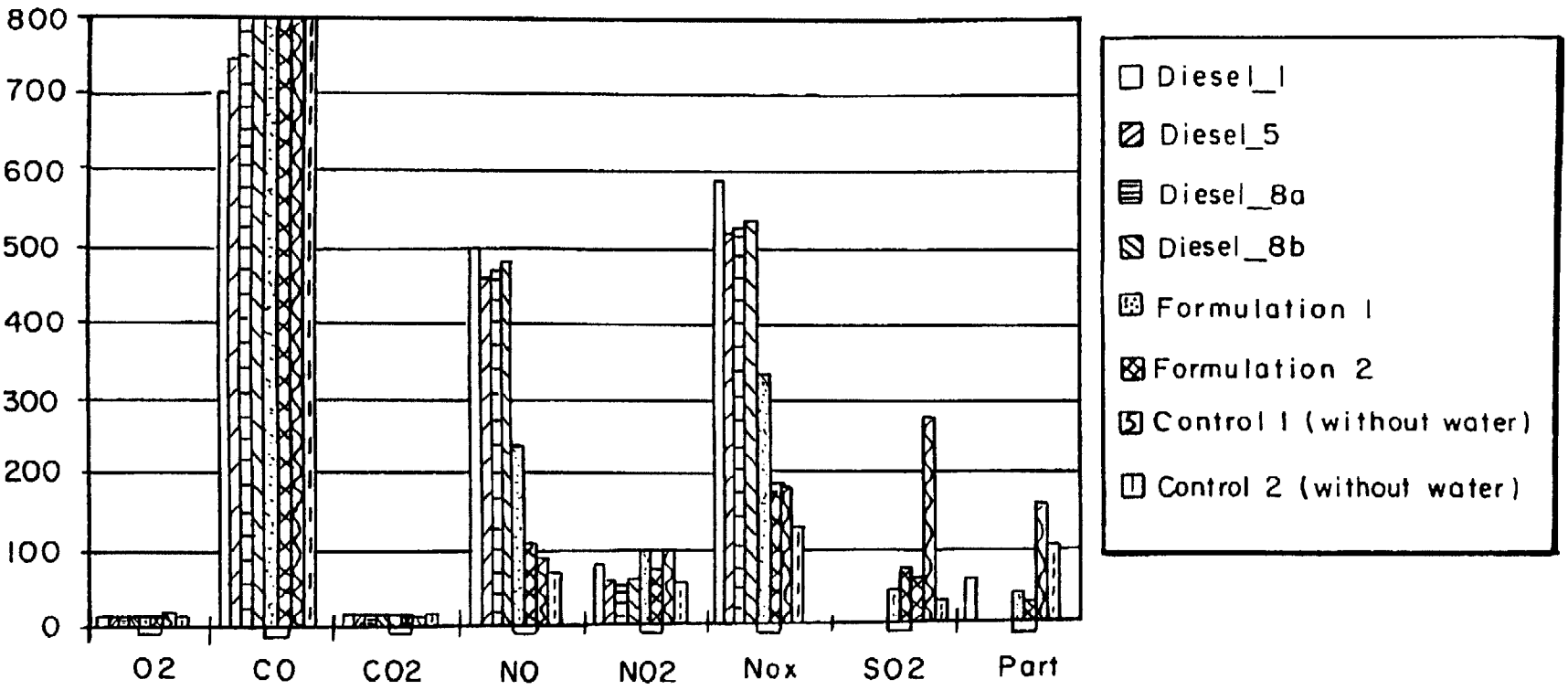
FIG. 16 presents emission data from combustion of water cluster/fuel emulsions of the present invention.

As described in Example 1, we have prepared various water cluster/fuel emulsions and have tested their combustive properties in a standard diesel engine, under normal operating conditions. FIG. 16 presents emission data compiled from combustion of these emulsions, and reveals that $NO_x$ and particulate emissions are reduced upon combustion of the inventive emulsions; CO levels may be increased.

Figure 15:
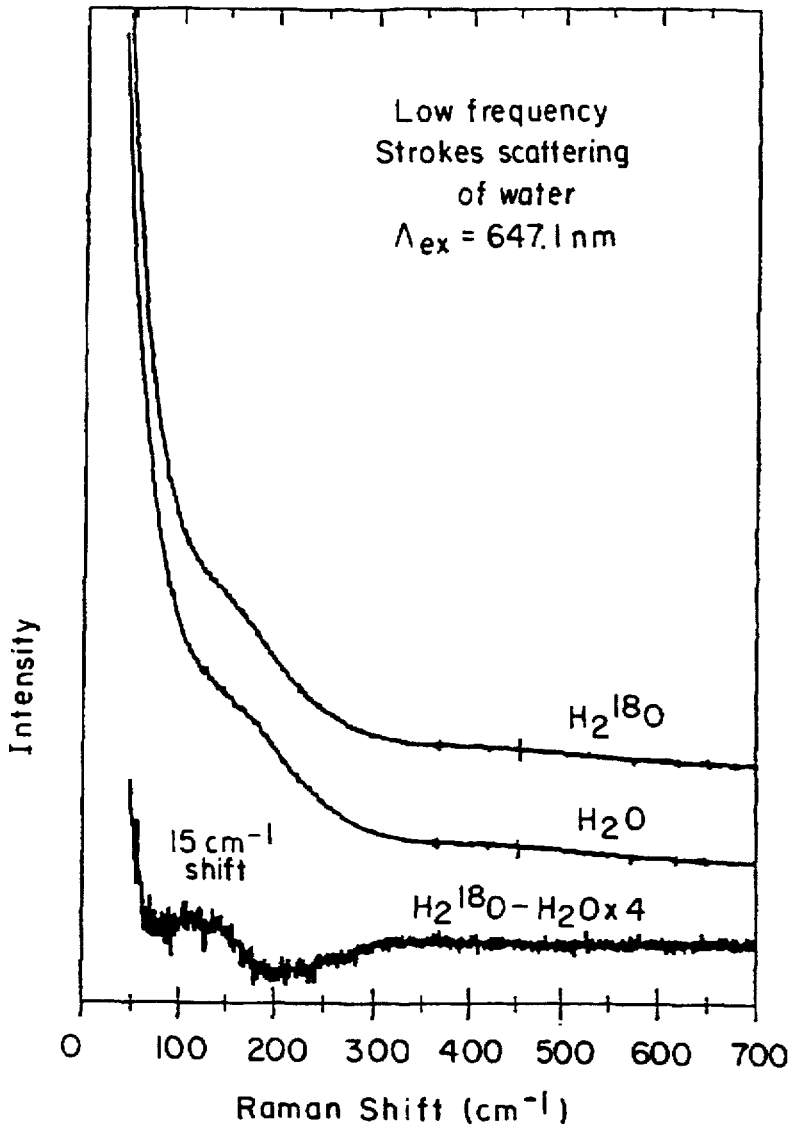
FIG. 15 presents an $H_2O/H_2O^{18}$ difference Raman spectrum for a water cluster/fuel emulsion of the present invention.

The water phase of the inventive emulsions described in Example 1 had a particle size of about 4–7 Å. Moreover, the phase was shown to include inventive water clusters, characterized by oxygen-oxygen vibrational modes. Specifically, an isotope effect was observed in the region of about 100–150 $cm^{-1}$ of the Raman spectra of emulsions containing $H_2O^{18}$ (see FIG. 15). This effect reveals that vibrations including oxygens are responsible for the spectral lines observed in that region.

The results presented in FIG. 16 were achieved by combusting diesel or water cluster/diesel emulsions in a standard diesel engine. The present invention can therefore readily be implemented with existing technology. However, an additional aspect of the invention involves altering the design of engines used in combustion of water cluster/fuel compositions of the present invention.

One embodiment of an altered engine for use in the practice of the present invention is a derivative of standard diesel engine, altered so as not to have a functional air intake valve. Given that the oxygen used in combustion of the inventive water cluster/fuel compositions can come from the water instead of from air, air intake should not be required.

Figure 17:
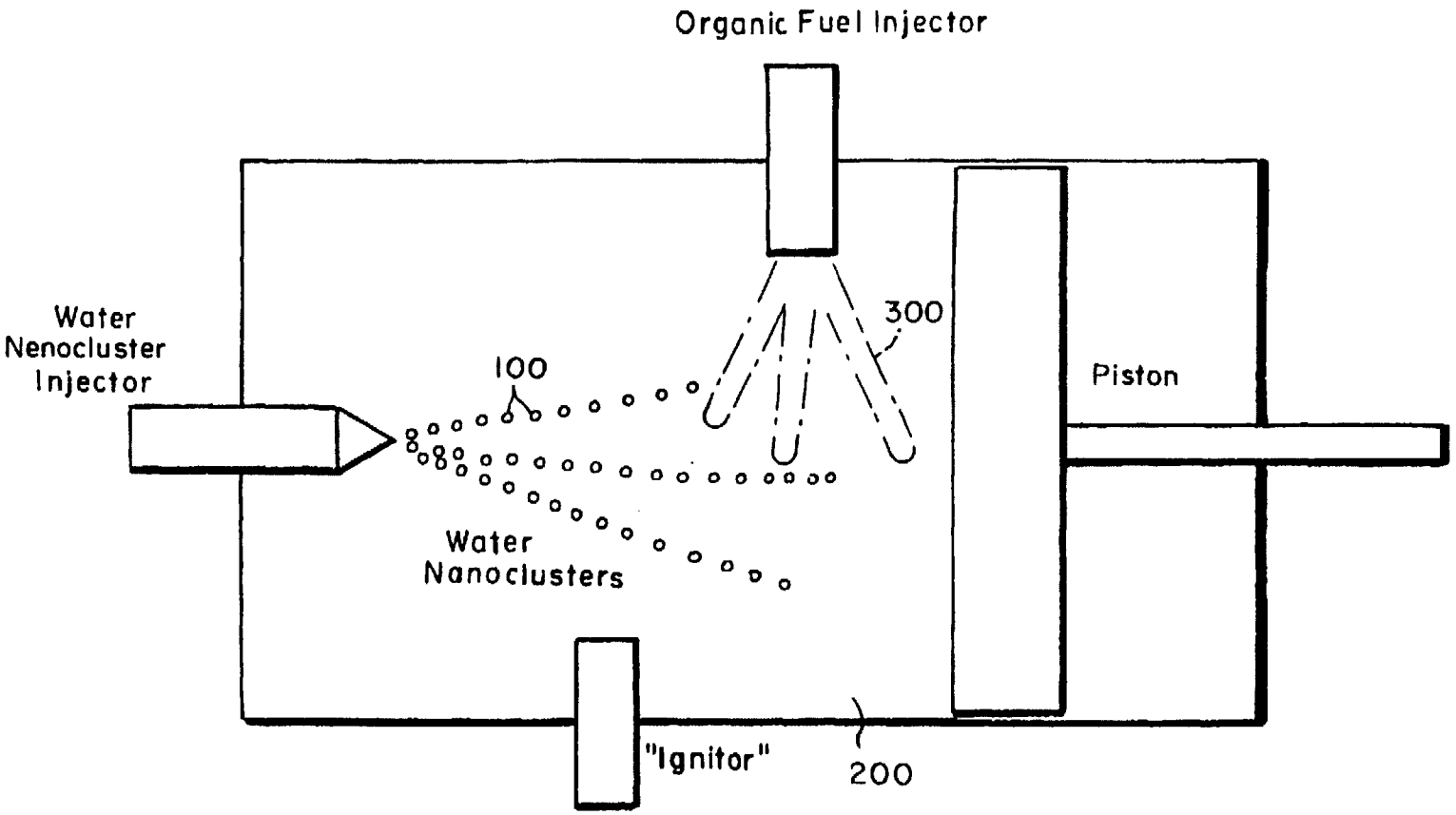
FIG. 17 depicts a new engine designed for combustion of water cluster/fuel compositions of the present invention.

More dramatic changes in engine design are also envisioned. For example, FIG. 17 presents one embodiment of a new engine for combusting water cluster/fuel compositions of the present invention. As shown, water clusters 100 are injected into a chamber 200, into which fuel 300 is also injected. The water clusters may be prepared by any of the means described above, but preferably are prepared by ejection from a hypersonic nozzle. In preferred embodiments, the nozzle comprises a catalytic material. In some embodiments, the clusters are also ionized by passage through a potential.

As has been discussed herein, it is desirable to expose the fuel to the water clusters in a way that maximizes interaction between fuel carbons and water oxygens. Because pentagonal dodecahedral water structures have high surface reactivity particularly preferred embodiments of the invention inject individual pentagonal dodecahedral water structures into the chamber. One additional advantage of injecting water clusters into a chamber, and particularly of injecting individual pentagonal dodecahedral water structures, is that it allows the Coulombic repulsion between individual water clusters to be harnessed as kinetic energy, thereby increasing the energy available for conversion during combustion.

Once inside the chamber, the water cluster/fuel composition is ignited according to standard procedures. As mentioned above, air intake is not required.

Those of ordinary skill in the art will appreciate that many of the known variations to engine structure and combustion conditions may be incorporated into the present invention. For example, various additives may be included in the water cluster/fuel composition in order to improve combustibility, stability, lubricity or other desirable characteristics.

EXAMPLES

Example 1

Preparation and Analysis of Combustible Water Cluster/Fuel Emulsions

Water cluster/fuel emulsions were prepared according to the following method:

| COMPONENT | AMNT/GALLON EMULSION |
|---|---|
| Diesel | 0.55 Gal |
| Water | 0.22 Gal |
| Surfactant I | 1.07 lb |
| Surfactant II | 0.27 lb |
| Surfactant III | 0.10 Gal |

The water can be distilled water or tap water, or a mixture of water and a short chain alcohol such as methanol. Surfactant I has the structure $C_xH_{20}(OCH_2CH_2)_yOH$, where x=8–10 and y=4–10. Surfactant II is a polyglyceril-oleate or cocoate. Surfactant III is a short chain, ($C_{2-8}$) linear alcohol.

The emulsions were prepared by mixing the Diesel with Surfactant I and II. Water and surfactant III were then added simultaneously. The water nanodroplets in the emulsion had a grain size of about 4–7 Å. Two particular formulations were prepared that had the following components:

| Component | Amount (g) |
|---|---|
| Formulation 1 | |
| hexaethoxyoctanol | 155.5 |
| polyglyceril-oleate | 25.9 |
| diesel | 592.5 |
| water | 148.4 |
| pentanol | 77.7 |
| Formulation 2 | |
| hexaethoxyoctanol | 148.7 |
| polyglyceril-oleate | 37.2 |
| diesel | 504.8 |
| water | 216.3 |
| 40:60 butanol:hexanol | 9.29 |

Raman spectra of Formulation 2, were taken using laser excitation at both 406.7 nm and 647.1 nm. The spectra at 406.7 nm were highly fluorescent and only anti-stokes scattering/emission was carefully examined. The results at 647.1 nm did not have these problems. Isotope shift experiments were performed by introducing $H_2O^{18}$ into the emulsions. The $H_2O/H_2O^{18}$ difference spectrum is presented as FIG. 15. As can be seen, a peak was observed around 100–150 $cm^{-1}$, in the region associated with oxygen-oxygen squashing vibrational modes. Accordingly, it was concluded that the Formulation 2 emulsion contained water clusters having at least pentagonal symmetry.

The water cluster/fuel emulsions were weighed and then were pumped into a small YANMAR diesel engine. Energy output, injection timing, and engine operation were monitored according to standard techniques. Exhaust samples were taken and emissions were analyzed also according to standard techniques.

FIG. 16 presents the results of emissions analysis of two water cluster/fuel emulsions, Formulation 1 and Formulation 2. As can be seen, $NO_x$ and particulate levels are reduced, and CO levels may be increased.

Other Embodiments

Those of ordinary skill in the art will recognize that the foregoing has provided a detailed description of certain preferred embodiments of the invention. Various changes and modifications can be made to the particular embodiments described above without departing from the spirit and scope of the invention. All such changes and modifications are incorporated within the scope of the following claims.

We claim:

1. A composition comprising:

fuel;

water clusters dispersed within the fuel, the clusters being characterized by having protruding delocalized pπ orbitals and having an average diameter of less than about 20 Å.

2. The composition of claim 1 wherein each water cluster comprises between about 5 and 300 water molecules.

3. The composition of claim 2 wherein each water cluster comprises between about 20 and 100 water molecules.

4. The composition of claim 3 wherein each water cluster comprises about 20 water molecules.

5. The composition of claim 1 wherein the water clusters contain arrangements of water molecules having at least partial pentagonal symmetry.

6. The composition of claim 5 wherein the water clusters contain arrangements of water molecules having at least partial pentagonal dodecahedral symmetry.

7. The composition of claim 6 wherein each water cluster comprises at least one pentagonal dodecahedral water cluster.

8. The composition of claim 7 wherein each water cluster comprises about 20 water molecules, arranged as a pentagonal dodecahedron.

9. The composition of claim 1 prepared by a method comprising:

providing the water clusters; and dispersing the water clusters in the fuel.

10. The composition of claim 9 wherein the step of providing comprises inducing oxygen-oxygen vibrational modes having vibrational frequencies in the near infrared to microwave region.

11. The composition of claim 10 wherein the step of providing comprises inducing oxygen-oxygen vibrational modes having vibrational frequencies in the range of about 5 $cm^{-1}$ to 250 $cm^{-1}$.

12. The composition of claim 10 wherein the step of inducing comprises applying an external field.

13. The composition of claim 10 wherein the step of inducing comprises inducing the oxygen-oxygen vibrational modes intrinsically through the dynamical Jahn-Teller effect.

14. The composition of claim 9 wherein the step of providing comprises ejecting water from a hypersonic nozzle so that pentagonal dodecahedral water structures are produced.

15. The composition of claim 14, wherein the step of ejecting comprises ejecting water from a hypersonic nozzle that comprises a catalytic material.

16. The composition of claim 15 wherein the catalytic material is selected from the group consisting of nickel and nickel alloys.

17. The composition of claim 9, wherein the step of providing comprises providing pentagonal dodecahedral water clusters.

18. The composition of claim 17 wherein the step of providing pentagonal dodecahedral water clusters comprises a method selected from the group consisting of clathration, addition of a surfactant, application of an electric spark of sufficient voltage and appropriate frequency, and application of ultrasonic waves.

19. The composition of claim 9, claim 14 or claim 15 wherein the step of providing comprises steps of:

providing neutral clusters; and ionizing the neutral clusters.

20. The composition of claim 1 or wherein the composition contains at least about 5% water.

21. The composition of claim 1 wherein the composition contains at least about 20–30% water.

22. The composition of claim 1 wherein the composition contains at least about 50% water.

23. The composition of claim 1 wherein the water clusters comprise a mixture of water with an alcohol.

24. The composition of claim 23 wherein the alcohol is selected from the group consisting of methanol and ethanol.

25. The composition of claim 1 wherein the fuel comprises a hydrocarbon.

26. The composition of claim 1 wherein the fuel comprises gasoline or diesel.

27. The composition of claim 1 wherein the fuel comprises diesel.

28. The composition of claim 1 wherein combustion of the composition in a standard diesel engine produces reduced particulate and $NO_x$ emissions as compared with combustion of pure diesel fuel in the engine.

29. The composition of claim 1 further comprising an additive selected to improve a characteristic selected from the group consisting of stability, combustibility, and lubricity.

30. A composition comprising:

diesel; and water clusters having an average dimension of less than about 20 Å dispersed within the fuel.

31. The composition of claim 30 wherein the water clusters have an average dimension of less than about 10 Å.

32. The composition of claim 31 wherein the water clusters have an average dimension of about 4–7 Å.

33. The composition of claim 30 wherein the water clusters are characterized by having protruding, delocalized pπ orbitals.

34. The composition of claim 30 wherein the water clusters have between about 5 and 300 water molecules.

35. The composition of claim 30 wherein the water clusters have between about 20 and 100 water molecules.

36. The composition of claim 30 wherein the water clusters have approximately 20 water molecules.

37. The composition of any one of claims 34–36 wherein at least some of the water molecules are arranged in structures having at least pentagonal symmetry.

38. The composition of claim 37 wherein the structures have pentagonal dodecahedral symmetry.

39. The composition of claim 38 wherein the each water cluster comprises about 20 water molecules arranged in a pentagonal dodecahedral structure.

40. A method of providing water clusters characterized by having protruding, delocalized pπ orbitals, the method comprising steps of:

providing liquid water; and ejecting the liquid water from a hypersonic nozzle comprising a catalytic material.

41. The method of claim 40 wherein the catalytic material is selected from the group consisting of nickel and nickel alloys.

42. A method of increasing efficiency of fuel combustion, the method comprising steps of:

providing water clusters characterized by having protruding delocalized pπ orbitals; and exposing the water clusters to fuel in a manner that allows overlap between the protruding pπ water cluster orbitals and orbitals associated with fuel carbons.

43. An engine comprising:

a chamber;

a water cluster injector characterized in that, when liquid water is introduced into the engine it passes through the water cluster injector in a manner that ejects water clusters characterized by having protruding delocalized pπ orbitals into the chamber; and a fuel injector, that injects fuel into the chamber in a manner that exposes fuel carbon orbitals to interaction with the water cluster pπ orbitals.

44. The engine of claim 43 wherein the water cluster injector comprises a hypersonic nozzle.

45. The engine of claim 44 wherein the hypersonic nozzle comprises a catalytic material.

46. The engine of claim 43 wherein the water cluster ejector is adapted to produce water clusters comprising pentagonal dodecahedral water structures.

* * * * *

UNITED STATES PATENT AND TRADEMARK OFFICE

CERTIFICATE OF CORRECTION

PATENT NO. : 5,800,576

DATED : September 1, 1998

INVENTOR(S) : Johnson *et al.*

It is certified that error appears in the above-identified patent and that said Letters Patent is hereby corrected as shown below:

Column 4, Line 38, please delete "i.e." and insert therefor --lie--.

Signed and Sealed this

Fifteenth Day of June, 1999

*Attest:*

Q. TODD DICKINSON

*Attesting Officer*

*Acting Commissioner of Patents and Trademarks*